US005495229A

United States Patent [19]

Balch et al.

[11] Patent Number: 5,495,229

[45] Date of Patent: Feb. 27, 1996

[54] PULSED ELECTRONIC ARTICLE SURVEILLANCE DEVICE EMPLOYING EXPERT SYSTEM TECHNIQUES FOR DYNAMIC OPTIMIZATION

[75] Inventors: Brent F. Balch, Fort Lauderdale; William R. Accolla, Loxahatchee; Scott A. Tribbey, Pompano Beach, all of Fla.

[73] Assignee: Sensormatic Electronics Corporation, Deerfield Beach, Fla.

[21] Appl. No.: 313,849

[22] Filed: Sep. 28, 1994

[51] Int. Cl.[6] ..... G08B 13/187

[52] U.S. Cl. ..... 340/551; 340/572

[58] Field of Search ..... 340/551, 572

[56] References Cited

U.S. PATENT DOCUMENTS 4,658,241 4/1987 Torre ..... 340/551

4,663,612 5/1987 Mejia et al. ..... 340/551

5,023,598 6/1991 Zemlock et al. ..... 340/572

5,349,332 9/1994 Ferguson et al. ..... 340/551

*Primary Examiner*—Glen Swann, III

*Attorney, Agent, or Firm*—Robin, Blecker, Daley & Driscoll

[57] ABSTRACT

An electronic article surveillance system has a receiver with a plurality of receiving coils. Each coil in the system is treated as a separate detection unit with its own noise environment which is distinct from the noise environments of the other coils in the system. This allows the system to optimize its performance by maximizing the sensitivity of each coil according to its own local noise environment. In EAS systems in accordance with the invention, the priority of the detection routines is to keep an accurate and up-to-date picture of the noise environment for each coil in "noise phases" and to look for tags during "transmit phases". Upon tag detection, a controller establishes a validation sequence comprising a number of cycles and can change the number of cycles adaptively to the noise environment.

60 Claims, 13 Drawing Sheets

PULSED ELECTRONIC ARTICLE SURVEILLANCE DEVICE EMPLOYING EXPERT SYSTEM TECHNIQUES FOR DYNAMIC OPTIMIZATION

FIELD OF THE INVENTION

This invention relates generally to electronic article surveillance (EAS) and pertains more particularly to improved EAS systems.

BACKGROUND OF THE INVENTION

One present commercially implemented EAS system of the assignee hereof has a transmitter which radiates a pulsed magnetic field into a surveillance area wherein it is desired to note the presence of articles bearing EAS tags, also referred to in the EAS industry as labels or markers. When a tagged article is present in the surveillance area, its tag is excited by the radiated magnetic field and, based on its composition, is caused to generate a detectable response signal. A receiver, which is enabled between successively spaced transmitter field radiations, detects the response signal of the tag and initiates an alarm or other activity to indicate the presence of the tag in the surveillance area.

EAS systems are commonly installed in environments with high levels of electrical interference, such as retail store checkout areas. Interference sources commonly found in these areas include such items as electronic cash registers, laser product code scanners, electronic scales, coin changers, printers, credit card verifiers, point of sale (POS) terminals, neon signs, fluorescent and halogen lights, conveyor belt motors and motor speed controllers, and others.

The electrical noise environment presented to an EAS system in a retail checkout area is rarely constant. Various electronic devices in the area, such as those listed above, are turned on and off throughout the day, causing an ever-changing pattern of interference, both in the time and frequency domains.

Conventional techniques of filtering, such as band limiting and frequency notching, require extra hardware and often do not eliminate the interfering signals. They rely on improving the desired signal-to-noise ratio (SNR) by attenuating undesired out-of-band signals, while amplifying signals of interest, namely, tag signals.

Time domain approaches, such as receiver blanking and time window masking (discussed below) are effective, but have the drawback requiring extra hardware. Further, when the receiver is blanked or masked, it is incapable of responding to valid tag signals.

Another known practice for addressing electrically noisy EAS environments is the use of a phase canceling receiver antenna scheme. The most common scheme makes use of a FIG. 8 antenna configuration, wherein two substantially identical antennas are connected either in series or parallel, such that signal sources at a distance generate magnetic flux that cuts both coils equally, inducing equal and opposite currents in the coils. When the currents from the coils are summed, they cancel and the net amplitude from the distant source is reduced. This method of noise cancellation is very effective for many types of interference, but has a significant disadvantage in that a tag placed on or near the plane of symmetry between the FIG. 8 receiver pair also has its signal canceled, i.e., the tag is said to be in a receiver null zone. At times, environmental interference is so severe that the presence of null zones represents an acceptable compromise.

Frequency band limiting, done by filtering, is also an effective means of reducing noise interference. System receiver input filtering selectively passes certain frequencies which include the expected tag frequency characteristics and suppresses or blocks frequencies outside of the passband. However, interfering signals have frequencies near the expected tag frequency and are within the passband and are processed in the receiver.

Limiters and noise blankers also have seen use in addressing environmental noise, addressing high level and particularly short duration impulse noise (noise spikes). However, under certain conditions, tag signals can erroneously activate these circuits, causing them to block the desired tag signals.

The commercial EAS system of the assignee hereof above referred to generates a pulsed magnetic field in the form of short bursts of magnetic flux at a frequency to which the system tags are sensitive. The system tags are magnetically resonant at the particular system frequency and because of their significant Q, they will continue to respond or "ring" after the transmitter field is removed. This ringing response is unique and is detected by the system receiver. To protect the sensitive receiver circuitry from being overwhelmed by the high level transmitter field, the receiver circuitry is gated off until shortly after the end of the transmitter burst. For this reason and to prevent interaction between systems, this transmitter burst and receiver window must occur at precise points in time, commonly referenced to the local power line's zero crossing.

Because of the possibility of neighboring systems being powered by different phases from the local power lines, three distinct transmit/receive windows are provided for in the systems' timing scheme, each 120 degrees apart in phase. This strict timing sequence must be adhered to in order to prevent undesired system interaction. This critical timing system has the advantage that noise spikes and impulsive noise occurring at times when the receiver is gated off do not interfere with the system. The processor in the system routinely monitors the background noise for all receiver antennas in all three possible receiver phases. A composite noise average is computed and receiver gain is adjusted up or down to optimize system sensitivity with a varying noise environment. As the background noise average increases, the receiver gain is reduced to allow a defined signal-to-noise ratio to be met without danger of linear stages clipping.

Some repetitive impulsive noise sources can produce interfering signals during receiver windows however, so the system provides for time window masking, which prevents these high noise windows from being included in the average and reducing system sensitivity. Setting this time window masking is a manual step performed at the time of system installation or during servicing of the system.

Once a receiver window is masked, noise during that period no longer affects the average, but the window can no longer be used to process tag signals. If the impulse noise source changes its phase relationship to the power line's zero crossing, such as if the source is another piece of electronic equipment which is relocated or replaced with another unit, its interfering signal now can occur during a non-masked receiver window, reducing system sensitivity, and the masked receiver window is not freed up for system use.

SUMMARY OF THE INVENTION

The primary object of the present invention is provide an improved EAS system.

Another equally general object of the invention is to provide an EAS system with enhanced ability to successfully operate within high electrical noise environments.

A particular object of the invention is to address interference signals without the inefficiencies of window masking and with an adaptiveness to changing electrical noise environments.

Applicants entitle the subject invention above as involving "expert system" techniques. As defined in the *McGraw-Hill Dictionary of Scientific and Technical Terms*, Fifth Edition, the term "expert system" is "a computer system composed of algorithms that perform a specialized, usually difficult professional task at the level of (or sometimes beyond the level of) a human expert". In attaining the foregoing objects, the invention embodies such expert system techniques.

One fundamental concept of systems of the invention is unlike that of the commercial system above discussed, where a single noise source could reduce sensitivity for the entire system. Thus, per the invention herein, each coil in the system is treated as a separate detection unit with its own noise environment which is distinct from the noise environments of the other coils in the system. This allows the system to optimize its performance by maximizing the sensitivity of each coil according to its own local noise environment.

In EAS systems in accordance with the invention, the priority of the detection routines is to keep an accurate and up-to-date picture of the noise environment for each coil in "noise phases" and to look for tags during "transmit phases", both hereinafter defined. Preferably, the picture of the noise environment is expanded to include examining noise per coil per phase. Thus, where the system is powered from three-phase mains, each of the A, B and C phases defines a period of time for prescribed system activity, and such time periods can be "noise phases", also hereinafter defined.

During noise phases, the current in-band measurement taken at the front end of the receiver is added to a historical record of the noise for that particular coil while the oldest measurement is discarded. These measurements are then averaged to create the system's overall picture of the noise environment for that coil, and for each power mains phase, where applicable. Typically, the record includes ten entries at any time.

During transmit phases, the instantaneous measurement from a particular coil is compared with the noise average for that coil in a specific power mains phase, where applicable, and if the ratio of the instantaneous to average values meets the user set signal-to-noise criterion, the system will then enter a "validation sequence".

In the validation sequence, a tag is looked for iteratively for the user set number of successive "hits" and, in the penultimate look, the system introduces a check for the possibility that the tag return is from a deactivated tag.

A further feature of the invention resides in another fundamental concept, namely, systems per the invention can incorporate "adaptive validation sequences", wherein the number of cycles of a validation sequence varies from the user-set cycle number correspondingly with the noise environment.

The system incorporates a frequency-hopping algorithm which allows it to better detect labels with wide frequency distribution.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
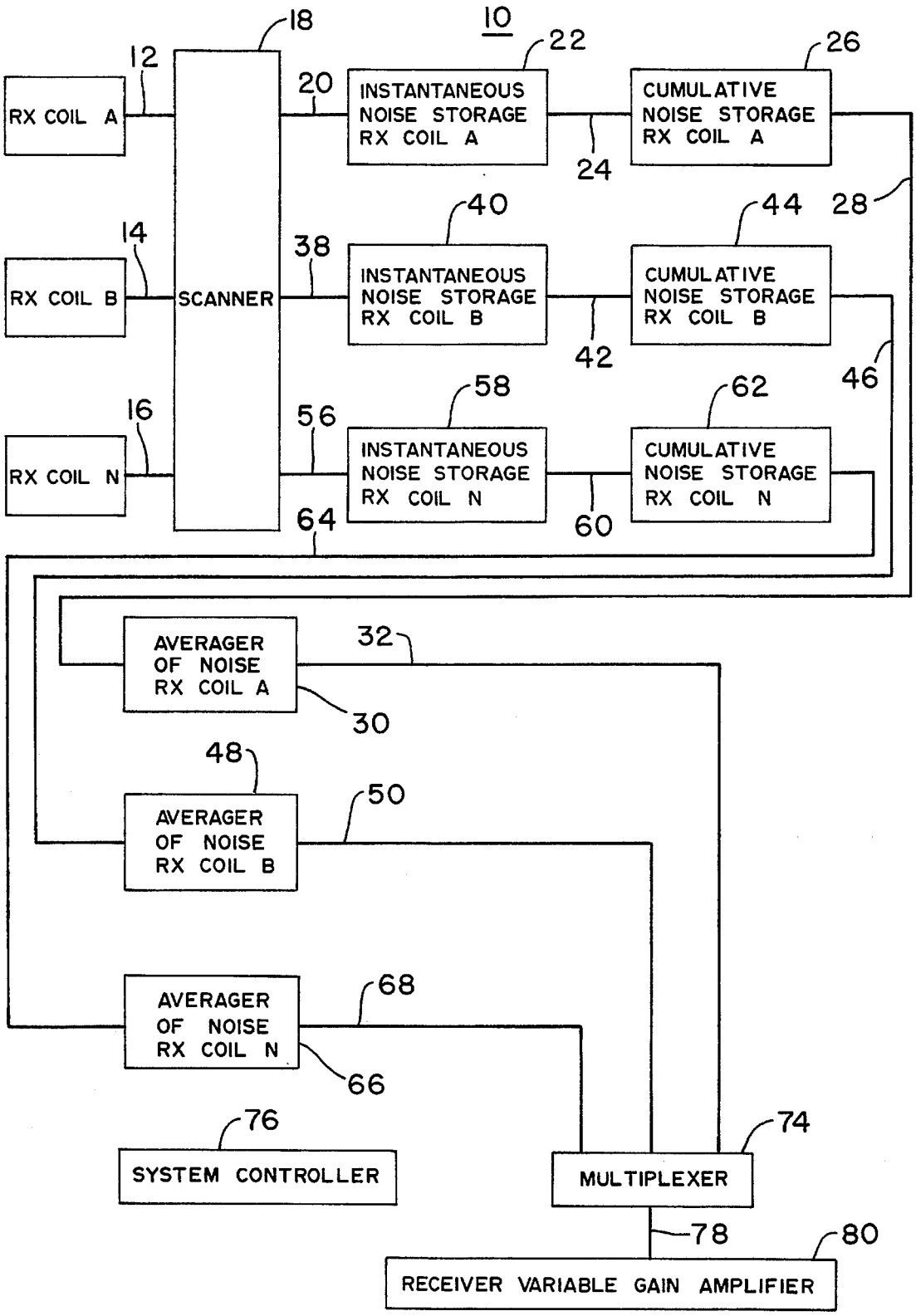
FIG. 1 shows a functional block diagram of a first embodiment of an environment noise analyzer of an EAS system in accordance with the invention.

Referring to FIG. 1, noise environment analyzer 10 is shown in combination with receiving coils RX COIL A, RX COIL B, RX COIL N. The analyzer can be expanded for use with any number of receiving coils, as desired.

The receiving coil output signals are desirably amplified at the coil situs and are furnished over lines 12, 14 and 16 to scanner 18. The scanner looks sequentially at lines 12, 14 and 16 and on looking at each line multiplexes that line with its counterpart one of scanner output lines.

Taking the scan of RX COIL A, scanner 18 connects line 12 to line 20, whereby the noise environment of RX COIL A is conveyed to instantaneous noise storage A 22. The content of storage 22 is furnished over line 24 to cumulative store A 26, whereby the historical record of noise for RX COIL A is compiled and is available on lines 28 for noise averager A 30, which outputs average noise for coil A on line 32.

Taking the scan of RX COIL B, scanner 18 connects line 14 to line 38, whereby the noise environment of RX COIL B is conveyed to instantaneous noise storage B 40. The content of storage 40 is furnished over line 42 to cumulative store B 44, whereby the historical record of noise for RX COIL B is compiled and is available on lines 46 for noise averager B 48, which outputs average noise for coil B on line 50.

Taking the scan of RX COIL N, scanner 18 connects line 16 to line 56, whereby the noise environment of RX COIL N is conveyed to instantaneous noise storage N 58. The content of storage 58 is furnished over line 60 to cumulative store N 62, whereby the historical record of noise for RX COIL N is compiled and is available on lines 64 for noise averager N 66, which outputs average noise for coil C on line 68.

Lines 32, 50 and 68 provide inputs to multiplexer 74, the operation of which is controlled by system controller 76. The multiplexer output on line 78 is furnished to receiver variable gain amplifier 80 such that, as returns from RX COIL A are being processed, the gain of amplifier 80 is set correspondingly with the average noise level of that coil. Thus, the lower the average noise level, the higher can be the receiver sensitivity for processing returns from RX COIL A. Multiplexer 74 is likewise operated by controller 76 to maximize receiver sensitivity for RX COIL B and RX COIL N while the receiver is processing returns respectively from these receiving coils.

Figure 2A:
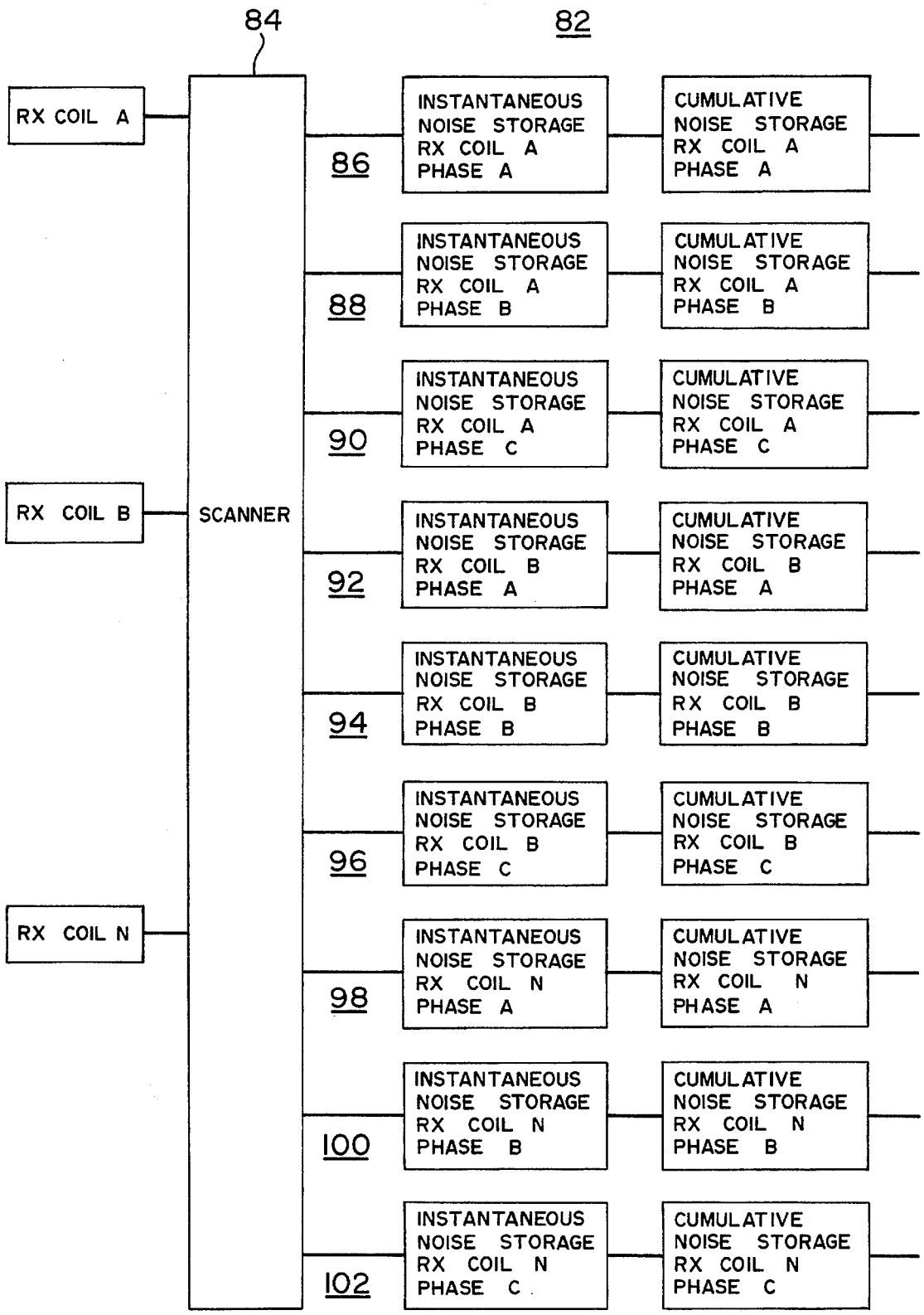
FIGS. 2A–2B show a functional block diagram of a second embodiment of an environment noise analyzer of an EAS system in accordance with the invention.
Figure 2B:
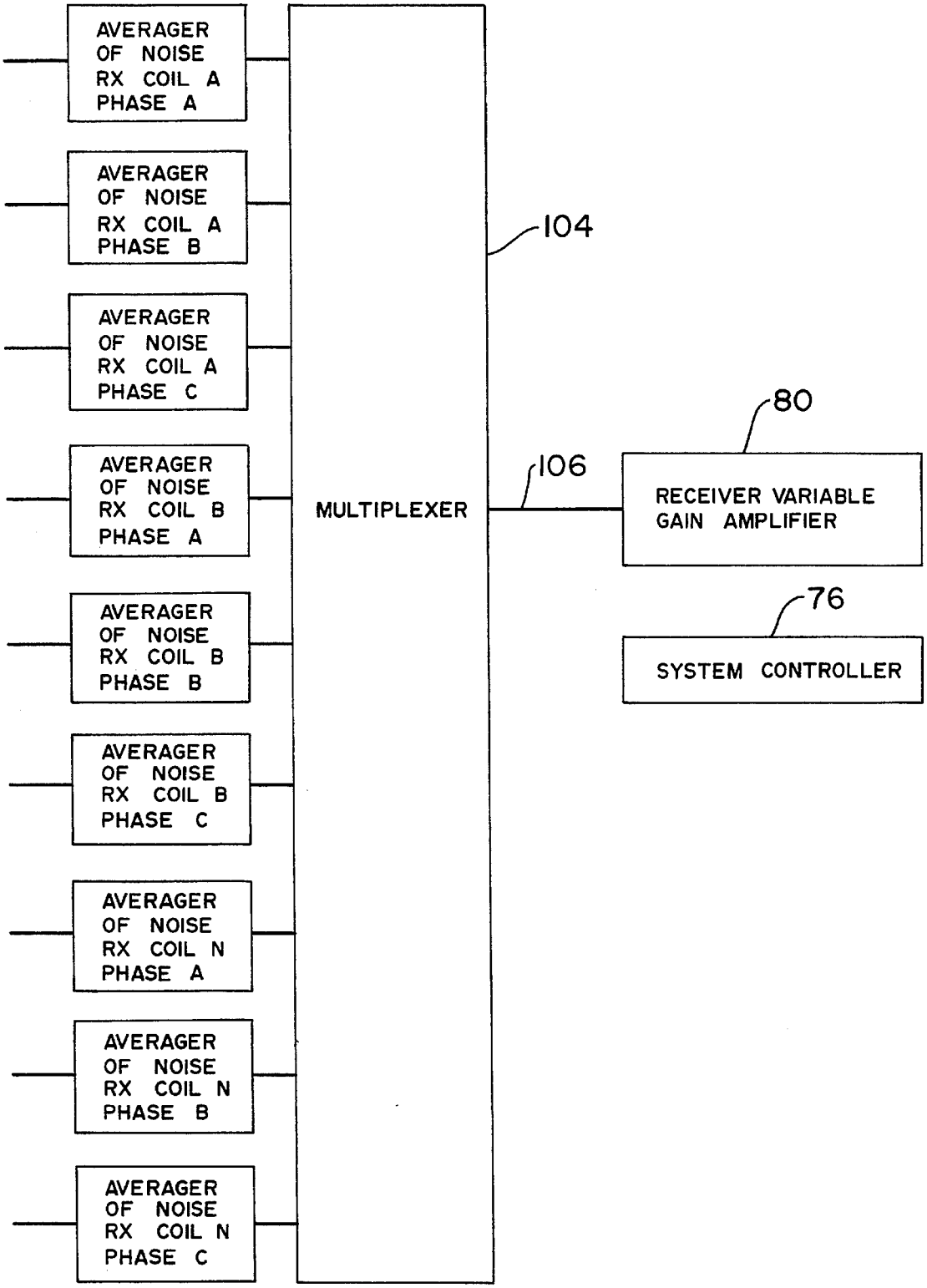

Turning to FIGS. 2A–2B, noise environment analyzer 82 is shown in combination with receiving coils RX COIL A, RX COIL B, RX COIL N.

Whereas, in analyzer 10 of FIG. 1, one channel for average noise computation is provided for each participating receiving coil, in analyzer 82, three channels are provided for each participating coil and output noise averages are provided per coil per phase. Scanner 84 functions as did scanner 18, but is expanded to scan the receiving coils for each of phases A, B and C of the power mains. The participating channels, each of which is configured correspondingly with those of FIG. 1, are noted by reference numerals 86 through 102.

Channel 86 analyzes returns from RX COIL A during phase A, channel 88 analyzes returns from RX COIL A during phase B, and channel 90 analyzes returns from RX COIL A during phase C. Channels 92, 94 and 96 perform likewise for RX COIL B and channels 98, 100 and 102 perform likewise for RX COIL N.

Multiplexer 104 receives the noise averages from each channel under timing control from system controller 76. The multiplexer output on line 106 is furnished to receiver variable gain amplifier 80 such that, as returns from RX COIL A during phase A are being processed, the gain of amplifier 80 is set correspondingly with the average noise A for phase A, etc.

The showings of FIGS. 1 and 2A–2B will be seen to implement the one fundamental concept of the invention, above alluded to, i.e., each coil in the system is treated as a separate detection unit with its own noise environment which is distinct from the noise environments of the other coils in the system. The treatment may be on a per coil basis or on a per coil and per phase basis. This allows the system to optimize its performance by maximizing the sensitivity of each coil according to its own local noise environment.

Figure 3:
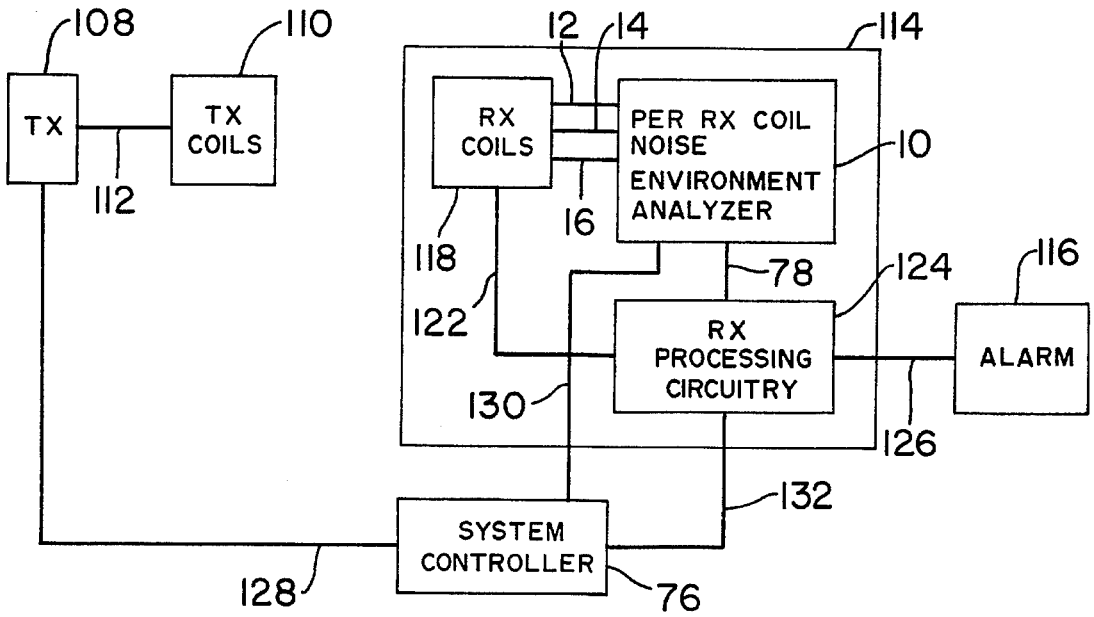
FIG. 3 shows a functional block diagram of a first embodiment of an EAS system in accordance with the invention.

Referring to FIG. 3, a first system embodiment is shown in a functional block diagram and includes transmitter (TX) 108 which drives transmitter coils (TX COILS) 110 over lines 112, a receiver 114, a system controller 76 and an alarm 116. Receiver 114 includes receiver coils 18 (RX COILS), the outputs of which are furnished over lines 12, 14 and 16 to unit 10 (PER RX COIL NOISE ENVIRONMENT ANALYZER), discussed above, and over lines 122 to tag return processing circuitry 124 (RX PROCESSING CIRCUITRY), which controls alarm 116 over lines 126. Analyzer 10 controls receiver amplifier gain by its signals on its multiplexer output line 78, as above discussed. System controller 76 has connection with transmitter 108, analyzer 10 and processing circuitry 124 respectively over lines 128, 130 and 132.

Figure 4:
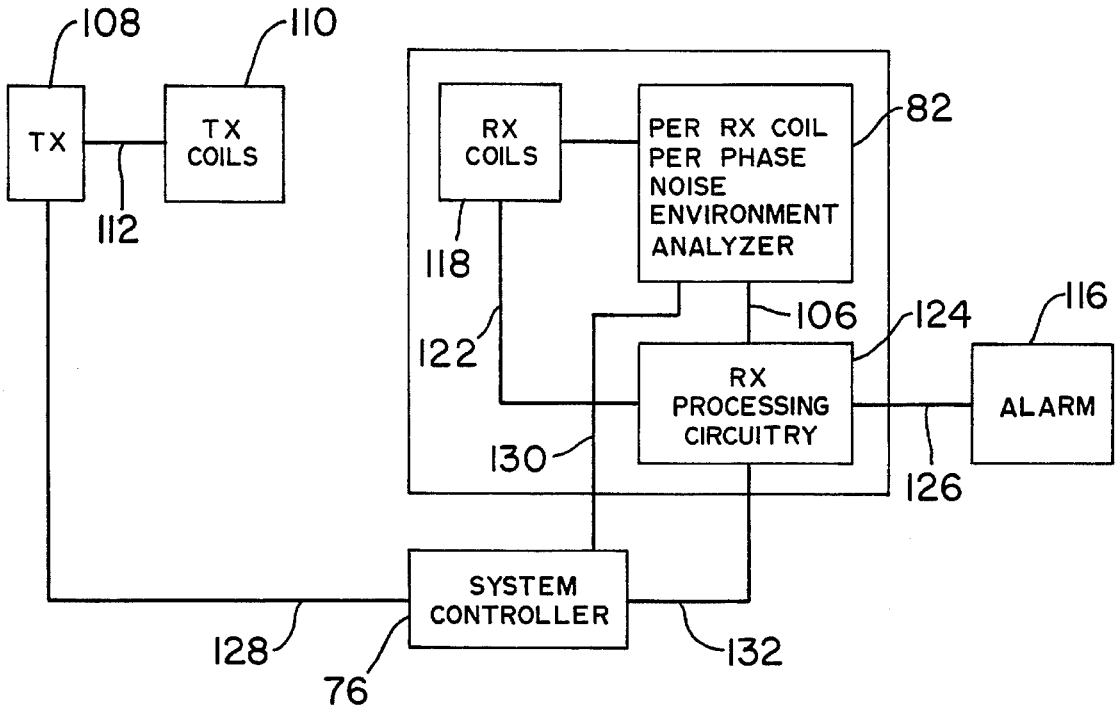
FIG. 4 shows a functional block diagram of a second embodiment of an EAS system in accordance with the invention.

FIG. 4 will seen to show a second system embodiment, which is identical with that of FIG. 3, except for its use of analyzer 82 whose multiplexer output line 106 controls receiver gain.

By way of introduction to further description of systems in accordance with the invention, it has certain counterparts to the referenced commercial system and various differences therefrom. Thus, as in that system, it operates in synchronization with the zero crossings of the line voltage by which it is powered. Since a single phase power supply may originate from any of the three possible phases of the power mains, the system synthesizes the alternate two phases of the line, spaced one hundred and twenty degrees from one another. This ensures that the transmitter of one system will not interfere with the receiver of another system connected to a different phase of the power mains. The system transmits with a burst frequency of one and one-half times (1.5×) line frequency by synchronizing its transmitter bursts to alternating phases of the line. There is a short delay (default 400 us) between the transmit burst and receiver window. This delay is there to allow the high Q circuit of the transmitting antenna and amplifier to "ring down" all remaining energy stored in the circuit before the receiver begins accumulating in-band energy from the receiving coils. In this way, energy from tags will be measured by the receiver.

Diversely from the referenced commercial system, the system of the invention under control of system controller 76 implements a frequency-hopping algorithm which allows it to better detect tags with a wider frequency distribution than the referenced commercial system. This frequency hopping takes place between two standard frequencies. These frequencies are 200 Hz above and below the fundamental frequency of 58 KHz. The system hops from one frequency to the other at every line sync (Phase A). Since the system can only process two input receiver coils in a single phase (its receiver is dual-channeled), it also hops between pairs of input coils or pedestals. This coil pair hopping takes place at 1.5× the line frequency, on every second line phase. The system of frequency and coil pair hopping ensures that every coil input will be measured at each different frequency and each different phase of the power line for both transmit and noise phases.

The system has an active mode, which has a transmit phase and a noise phase. The transmit phase includes a transmitting period (transmit window) and a receiving period (receive window). The following definitions apply.

Transmit phase: This is a phase of the power line during which the transmitter burst is enabled. Since tags respond to the transmitter by producing an in-band energy burst, this phase is used to determine if there is a hit, below defined.

Signal-to-noise ratio (SNR): The signal-to-noise ratio is the criterion used to verify a hit. This criterion is set in decibels (db).

Validation sequence (VALSEQ): The validation sequence is a sequence of transmit and noise check phases, in number set by the user or otherwise by default, that the system uses to verify that current in-band energy is originating from a tag. If a validation sequence reaches completion, i.e., finds hits for each of the set number of sequences of transmit and noise check phases, the tag is verified and the system alarm will activate.

Noise check phase: The noise check phase is a particular type of noise phase that takes place only during validation sequences. It is used to verify that an energy source causing in-band responses in transmit phases, is not also present in the same amplitude during noise phases. If the source is present for both, it is considered a continuous wave, unrelated to tag responses, and is ignored by the system.

Noise phase: The noise phase is a phase of the power mains during which the transmitter burst is disabled and is used to determine and record ambient noise levels for each receive coil in each phase.

Hit: A hit takes place when the ratio between the instantaneous measurement in a transmit phase of in-band energy and the average value of the noise environment is equal to or greater than the user specified signal-to-noise criterion. The system contemplates a user to set the SNR in db and offers a default of 12 db in the absence of user specified SNR criterion.

Hit phase: The hit phase is a phase during which the first hit of a validation sequence took place.

Deactivated tag check phase: During the next-to-last transmit burst of a validation sequence, the system switches its transmit and receive frequency to a frequency common to deactivated tags. During this transmit phase, the in-band measurement must fall below the preceding normal frequency transmit phase measurement by a determined amount in order for the validation sequence to continue. If this is not the case, the energy being measured is considered by the system to have come from a deactivated label and the validation sequence is terminated. If this is the case, practice is to return to the validation sequence for the last transmit burst of the validation sequence.

Figure 5:
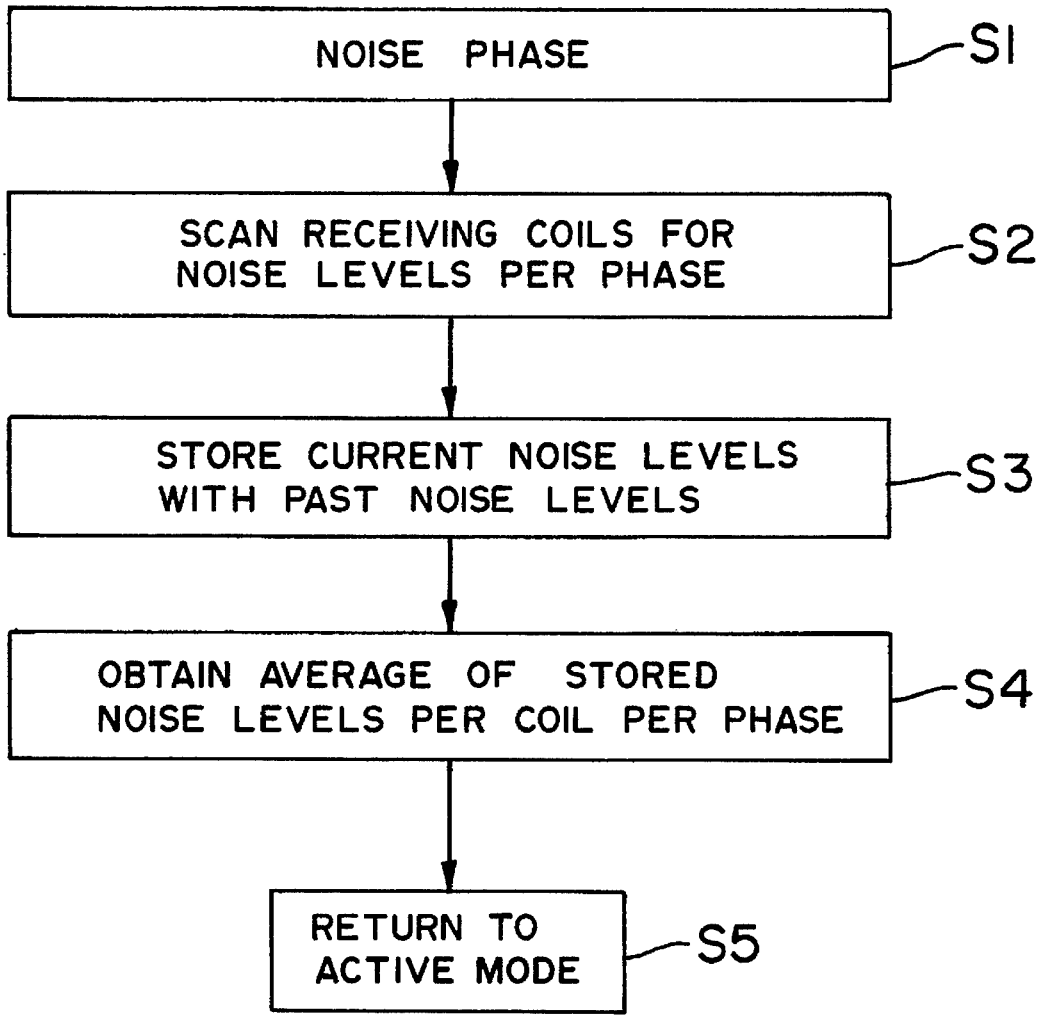
FIG. 5 shows a flow chart of a noise phase implemented by a microprocessor of a system controller.

Referring to FIG. 5, it shows a flow chart for a noise phase which is implemented by a microprocessor of system controller 76 with use of the FIG. 2A–2C type of noise environment analyzer. The microprocessor provides suitable timing for operation of scanner 84 and for the various storing and noise average computing operations of the circuitry of channels 86–102 and also controls the operation of multiplexer 104.

The phase is entered in step S1, NOISE PHASE. In step S2, SCAN RECEIVING COILS FOR NOISE LEVELS PER PHASE, the returns from all participating coils are examined for each phase of the power mains. In step S3, STORE CURRENT NOISE LEVELS WITH PAST NOISE LEVELS, the noise per coil per phase is accumulated. In step S4, OBTAIN AVERAGE OF STORED NOISE LEVELS PER COIL PER PHASE, the average computation is made per coil per phase. Step S5, RETURN TO ACTIVE MODE, is the end of the noise phase.

As above noted, system controller 76 coordinates operation of multiplexer 104 such that the receiver gain is set correspondingly in the receive window of the transmit phase with the particular coil and phase providing the signal being processed for a hit.

Figure 6:
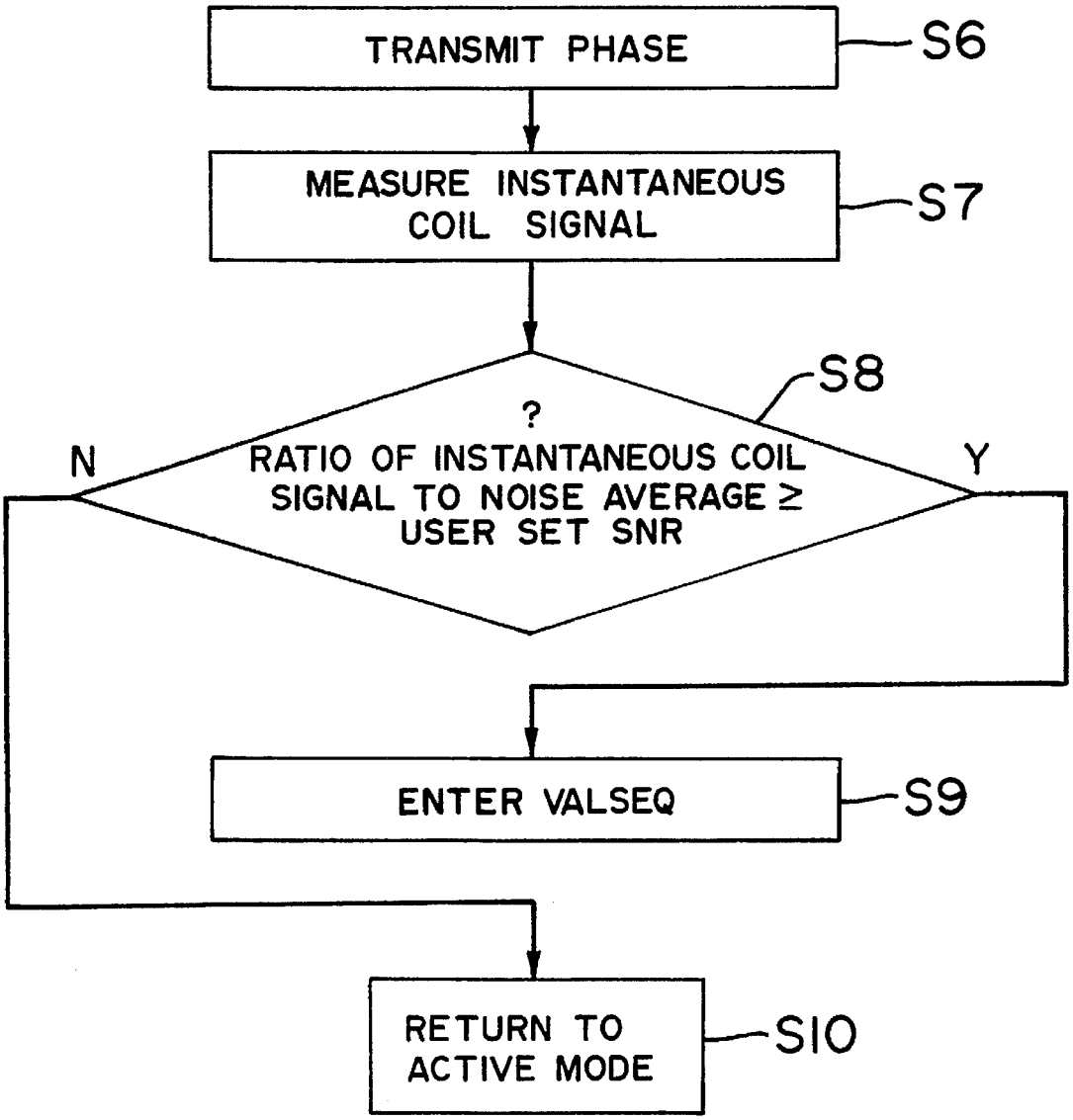
FIG. 6 shows a flow chart of a transmit phase implemented by a microprocessor of a system controller.

Referring to FIG. 6, it shows a flow chart for a transmit phase which is implemented by the microprocessor of system controller 76 with use of the hardware of the FIG. 4 EAS system. The microprocessor provides suitable timing for operation of such hardware, particularly the timing of transmitter and receiver operation and the reading out of average noise computed by the noise environment analyzer as above referred to for receiver gain control.

This phase is entered in step S6, TRANSMIT PHASE. In step S7, MEASURE INSTANTANEOUS COIL SIGNAL, the signal of a given receiving coil is conveyed to the receiver. In step S8, ? RATIO OF INSTANTANEOUS COIL SIGNAL TO NOISE AVERAGE≧USER SET SNR, inquiry is made as to whether the receiving coil signal level is greater than or equal to the user set signal-to-noise ratio. On affirmative (Y) answer to the step S8 inquiry, progress is to step S9, ENTER VALSEQ, whereby progress is to the validation sequence, discussed below. If the answer to the step S8 inquiry is in the negative (N), progress is to step S10, RETURN TO ACTIVE MODE.

Referring to FIG. 7, the validation sequence is entered in step S11, VALSEQ. In step S12, SET N=1, the sequence is initialized.

As will be made particularly clear by the example of system events in connection with FIGS. 10A–C hereinafter, the validation sequence looks to hit phases which are also transmit phases for tag validation. Non-hit, non-transmit phases are noise phases. This aspect of the invention is realized in the outset steps of VALSEQ, as follows.

Figure 7A:
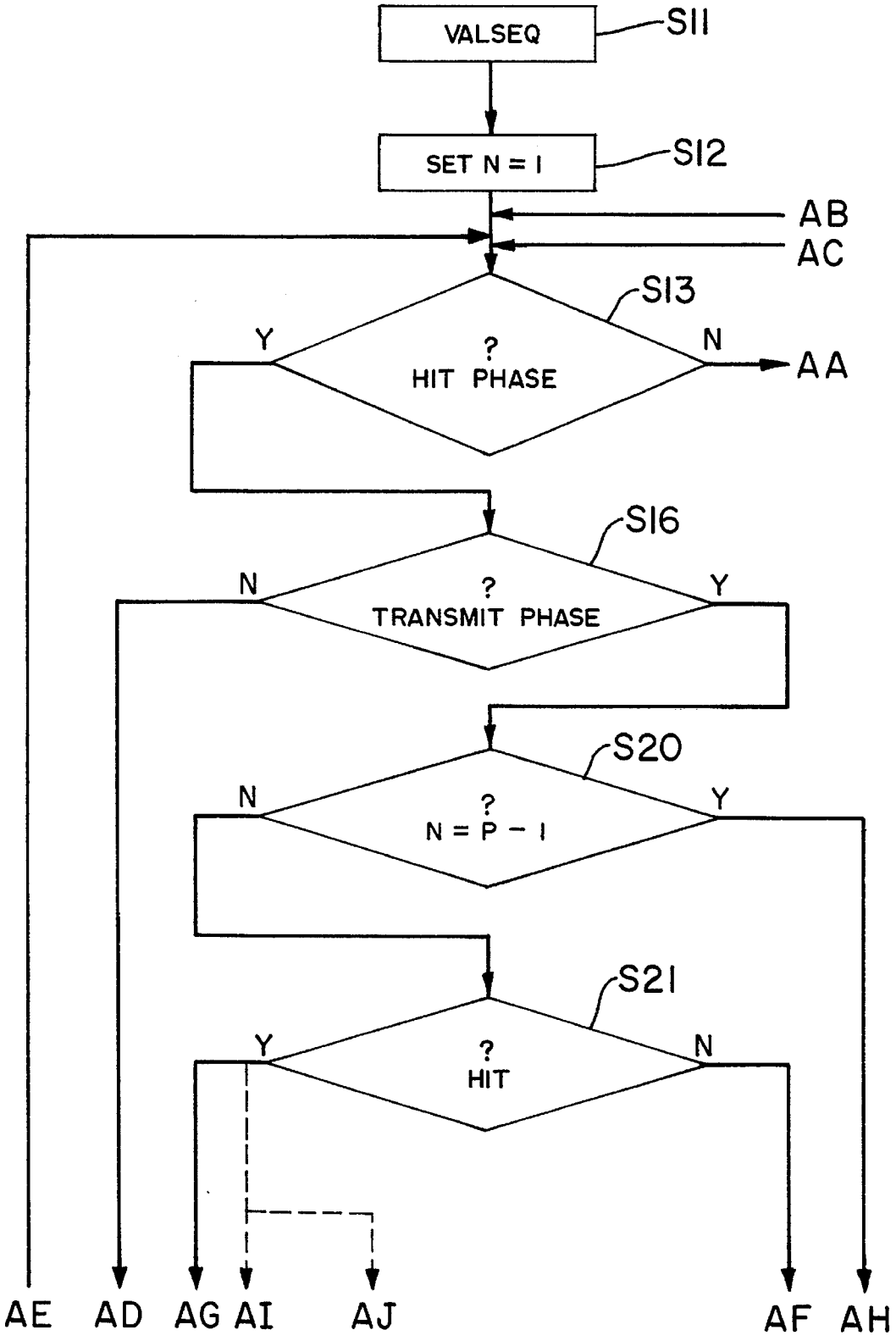
FIGS. 7 A–C show a flow chart of a first type of validation sequence.
Figure 7B:
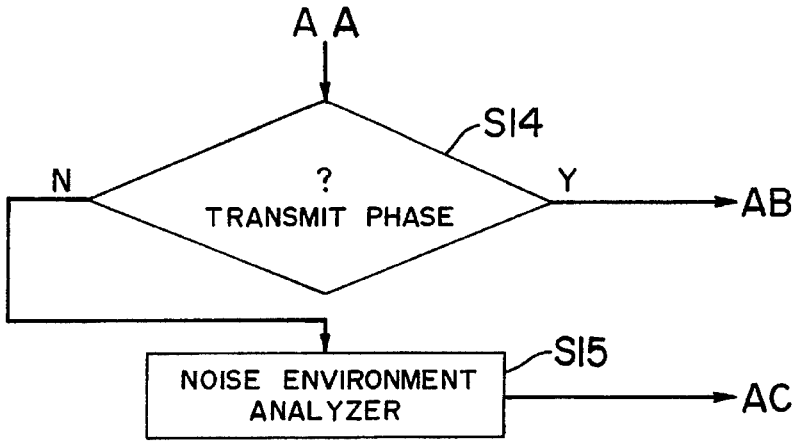
Figure 7C:
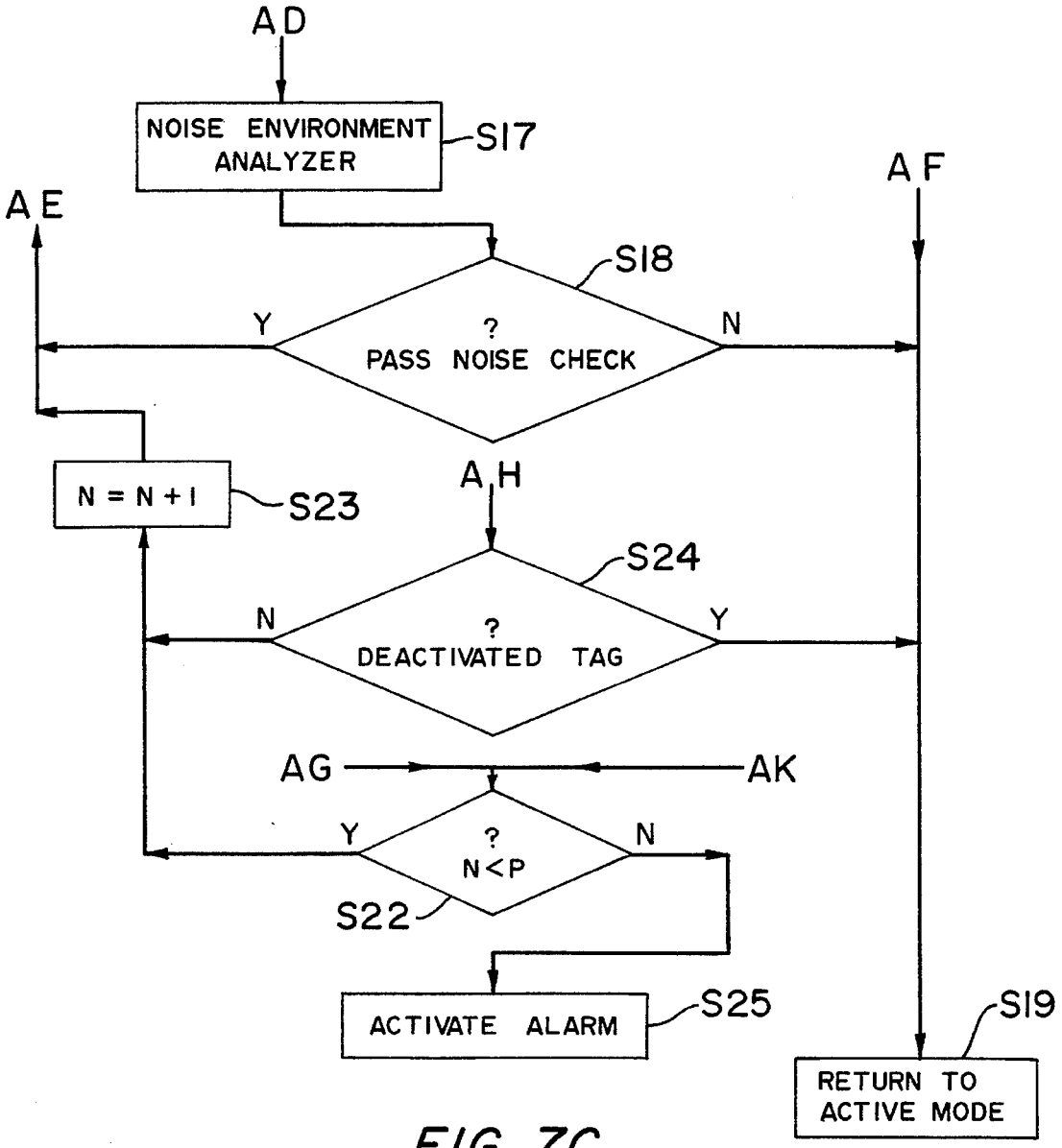

In step S13, ? HIT PHASE, inquiry is made as to whether the system is in the hit phase. If the response to the inquiry is negative, progress, as indicated by literals AA in FIG. 7A and in FIG. 7B, is to step S14, ? TRANSMIT PHASE. If the inquiry is answered in the affirmative, the system calls for a return, as indicated by the literals AB in FIG. 7A and FIG. 7B, to step S13. If the inquiry is answered in the negative, the system calls for the phase to be a noise phase, entering step S15, NOISE ENVIRONMENT ANALYZER, where noise averaging is updated and then return is made to step S13.

Where the step S13 inquiry is answered in the affirmative, progress is to step S16, ? TRANSMIT PHASE, where inquiry is made as to whether the current phase is a transmit phase. If the answer to the step S16 inquiry is in the negative, progress, as indicated by the literals AD in FIGS. 7A and 7C, is to step S17, NOISE ENVIRONMENT ANALYZER, where noise averaging is updated and then progress is to step S18, ? PASS NOISE CHECK, where the system looks for the continuous wave occurrence present in both noise and transmit phases. If the answer to the step S18 is in the negative, progress is to step S19, RETURN TO ACTIVE MODE.

On affirmative answer to the step S18, progress is to step S13, as indicated by the literals AE in FIGS. 7A and 7C.

Where the answer to the step S16 inquiry is in the affirmative, i.e., where transmit phase, hit phase is at hand, progress is to step S20, ? N=P−1, where P is the number of cycles required in VALSEQ, and inquiry is made as to whether VALSEQ is in its penultimate stage. If not, progress is to step S21, ? HIT, wherein inquiry is made as to the whether the signal being processed is a hit. If not, per literals AF in FIGS. 7A and 7C, progress is to step S19 and return to the active mode.

If the answer to the step S21 inquiry is affirmatively answered, progress is to step S22, ? N<P, per literals AG in FIGS. 7A and 7C. If so, i.e., VALSEQ has not reached its last cycle, progress is to step S23, N=N+1, where N is incremented by one and, per literals AE in FIGS. 7A and 7C, progress is to step S13 and continuance of VALSEQ.

If the answer to the step S20 inquiry is affirmatively answered, i.e., the penultimate cycle of VALSEQ has been reached and N becomes equal to P−1, progress, per literals AH in FIGS. 7A and 7C, is to step S24, ? DEACTIVATED TAG, where the system checks to determine whether the tag return being processed is from a deactivated tag.

Per the practice of the assignee hereof, when tags are deactivated, they shift to a resonant frequency different from tags which are not deactivated. In step S24, the system shifts to a frequency common to deactivated tags and the in-band measurement must fall below the preceding normal frequency transmit phase measurement by a determined amount in order for the validation sequence to continue. If this is not the case, the energy being measured is considered by the system to have come from a deactivated tag and step S24 is answered in the affirmative. The validation sequence is terminated, progress being to step S19, RETURN TO ACTIVE MODE. If this is the case, i.e., the tag is not a deactivated tag, progress is to step S23 to increment N and to return to step S13 for the validation sequence to enter the last cycle thereof.

As step S22 is again reached, it is now answered in the negative, N being equal to P, and progress is to step S25, ACTIVATE ALARM.

During the alarm mode, for each exit of an installation, the system turns off the transmitter since looking for tags is not a concern until the alarm stops. Having the transmitter off during alarms provides the system with the opportunity to quickly update all noise averages for all receiver coils since every phase is now a noise phase. During this period, coil pair switching will take place at 180 Hz. This ensures that all the averages will be current as soon as the alarm stops, even if a tag was close enough to the coils to start driving the averages up before the alarm took place.

While the VALSEQ of FIGS. 7A–C operates with a fixed value for P, the invention contemplates setting the value of P adaptively to environmental noise.

The foregoing discussion has not covered broken lines AI and AJ of FIG. 7A. As now discussed, these are optional alternates to line AG, stemming from affirmative answer to step S21.

Figure 8:
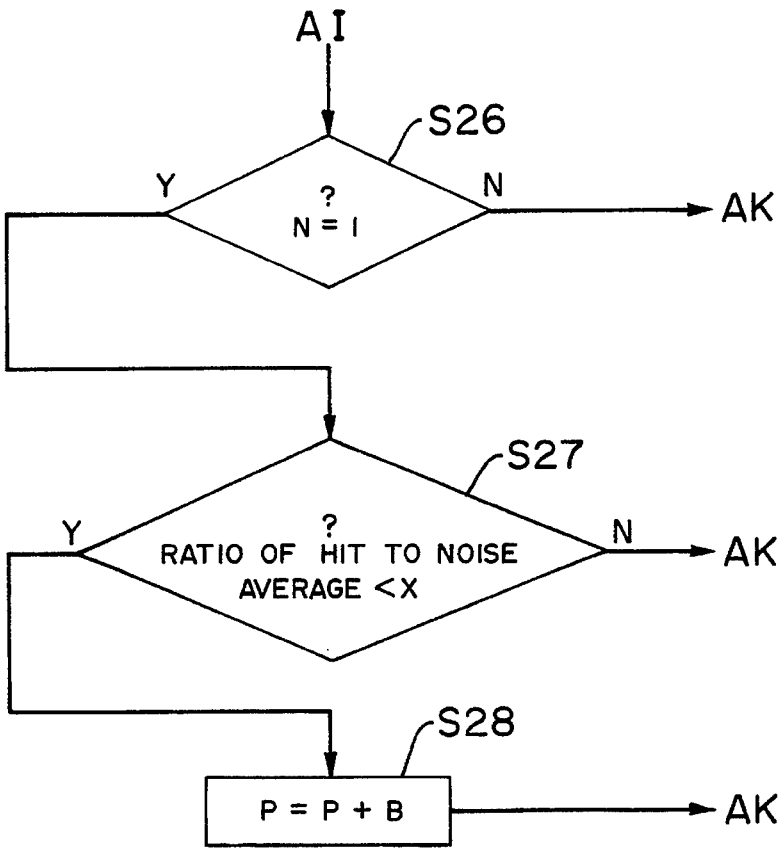
FIG. 8 shows a first routine for use in rendering the system implemented in the flow chart of FIGS. 7A–C adaptive to environmental noise to extend the validation sequence thereof.

Taking the option provided by broken line AI, a first modified VALSEQ proceeds, on affirmative answer to step S21, to line AI of FIG. 8, and to step S26, ? N=1, wherein inquiry is made as to whether the system is in the first cycle of VALSEQ. If the answer to the inquiry is in the negative, progress is over the AK lines of FIGS. 8 and 7C to step S22. If the answer to the inquiry is in the affirmative, progress is to step S27, ? RATIO OF HIT TO NOISE AVERAGE<X.

When the system enters a validation sequence, frequency hopping and coil pair hopping are disabled and the system focuses its attention on the input coil where the first hit was measured at the same frequency and in the same phase as the original hit. Since the probability of instantaneous noise values reaching a level above the SNR increases as this average becomes small, the routine of FIG. 8 may extend the number of hits necessary for an alarm if the first hit is close enough to the noise average. This provides greater immunity to false alarms due to random noise.

As an example, consider a system where the SNR is set to 12 db and the number of hits is set to 4. If the first hit is 20 db above the noise average, then the validation sequence continues with 4 hits required for an alarm. However, if the first hit is only 13 db above the noise average, then the algorithm may add several hits to the number required for an alarm. The thresholds and number of added hits used in the validation sequence extension practice is handled by the system and is transparent to the user.

In step S27, the system examines whether the return, although qualifying for a validation sequence, does not have at least an SNR of X, e.g., the above example of 20 db vs. a datum of 12 db. If the inquiry is answered in the negative, i.e., the ratio exceeds or is equal to X, then progress is to S22 over AK lines of FIGS. 8 and 7C, the same step to which line AG led.

Where the step S27 inquiry indicates the SNR to be less than X, e.g., the above example of 3 db vs. the datum of 12 db, progress is to step S28, P=P+B, where P, the required number of hits, is increased by B. Progress is then to S22 again over lines AK of FIGS. 8 and 7C.

The routine of FIG. 8 will be seen to look to only the first cycle of VALSEQ to determine whether adaptive extension of the cycles of VALSEQ need be increased. Thus, the step S26 inquiry is answered in the negative for N>1.

Figure 9:
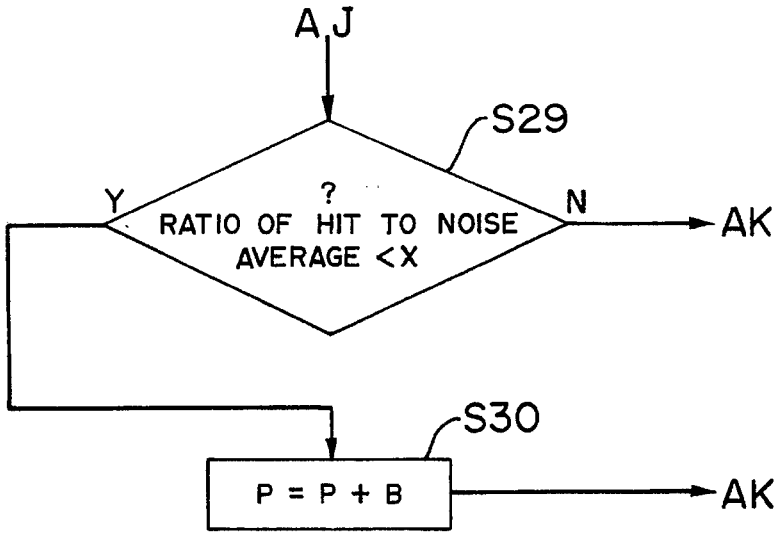
FIG. 9 shows a second routine for use in rendering the system implemented in the flow chart of FIGS. 7A–C adaptive to environmental noise to extend the validation sequence thereof.

The routine of FIG. 9, entered from broken line AJ of FIG. 7A differs, calling for practice of the inquiry of step S27 for each cycle of VALSEQ. Thus, the FIG. 9 routine omits step S26 and opens directly with step S29, ? RATIO OF HIT TO NOISE AVERAGE<X. If the ratio is adequate, progress is over lines AK of FIGS. 9 and 7C to step S22, i.e., VALSEQ is practiced with no change in P.

If step S29 is answered in the affirmative, progress is to step S30, P=P+B, and the cycles of VALSEQ are adaptively expanded by B and progress is over lines AK of FIG. 9 and FIG. 7C to step S22. P is thus incrementally expanded by B on each failure of the ratio test of step S29, unlike the single expansion of VALSEC in the first cycle thereof in the routine of FIG. 8. As desired, the modified VALSEQ of FIG. 9 may be practiced for a given number of cycles thereof, rather than for each cycle.

The thresholds and number of added hits used in the validation sequence extension practice are handled by the system and are transparent to the user.

Figure 10A:
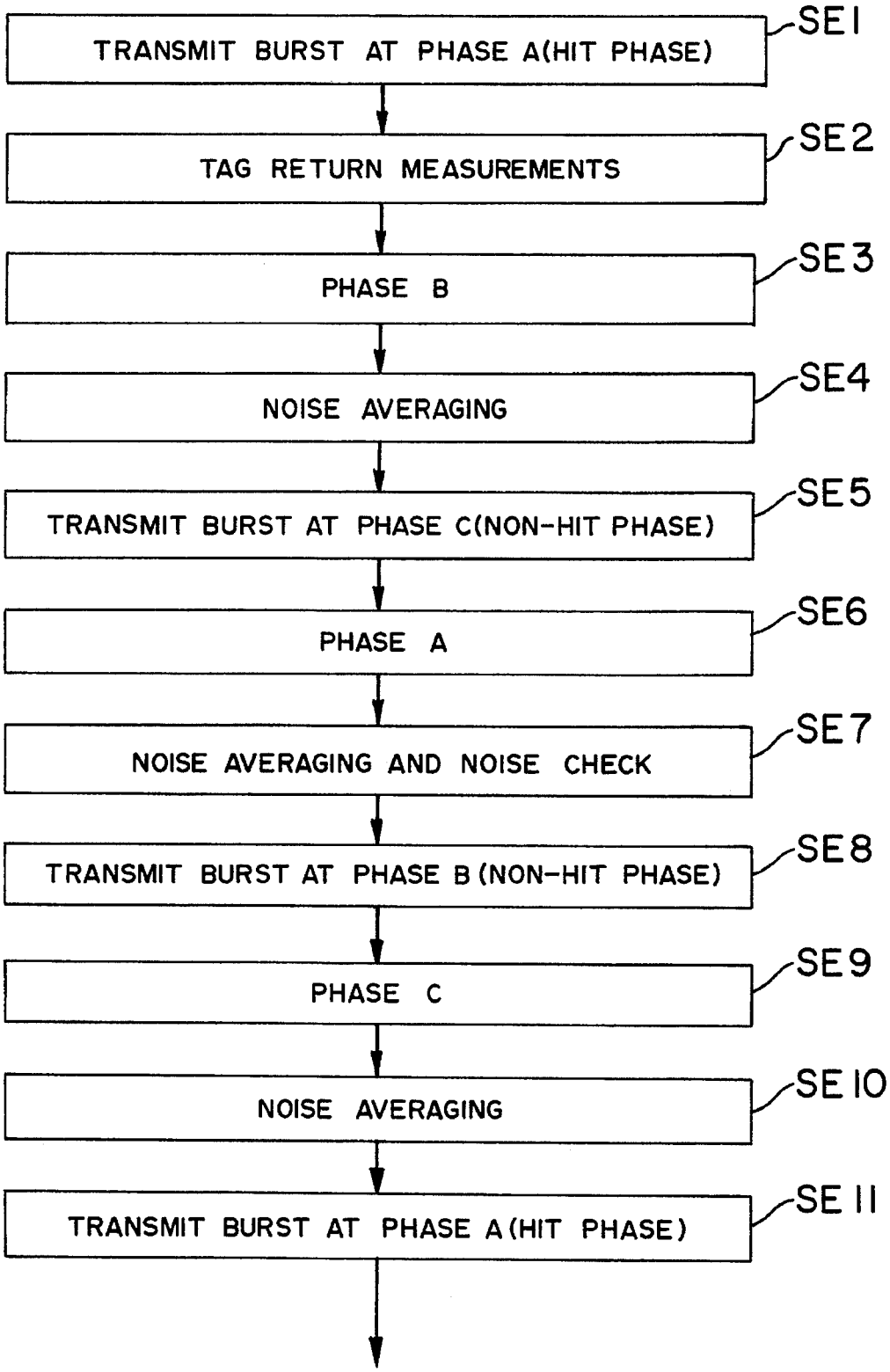
FIGS. 10A–C show a typical sequence of system events.
Figure 10B:
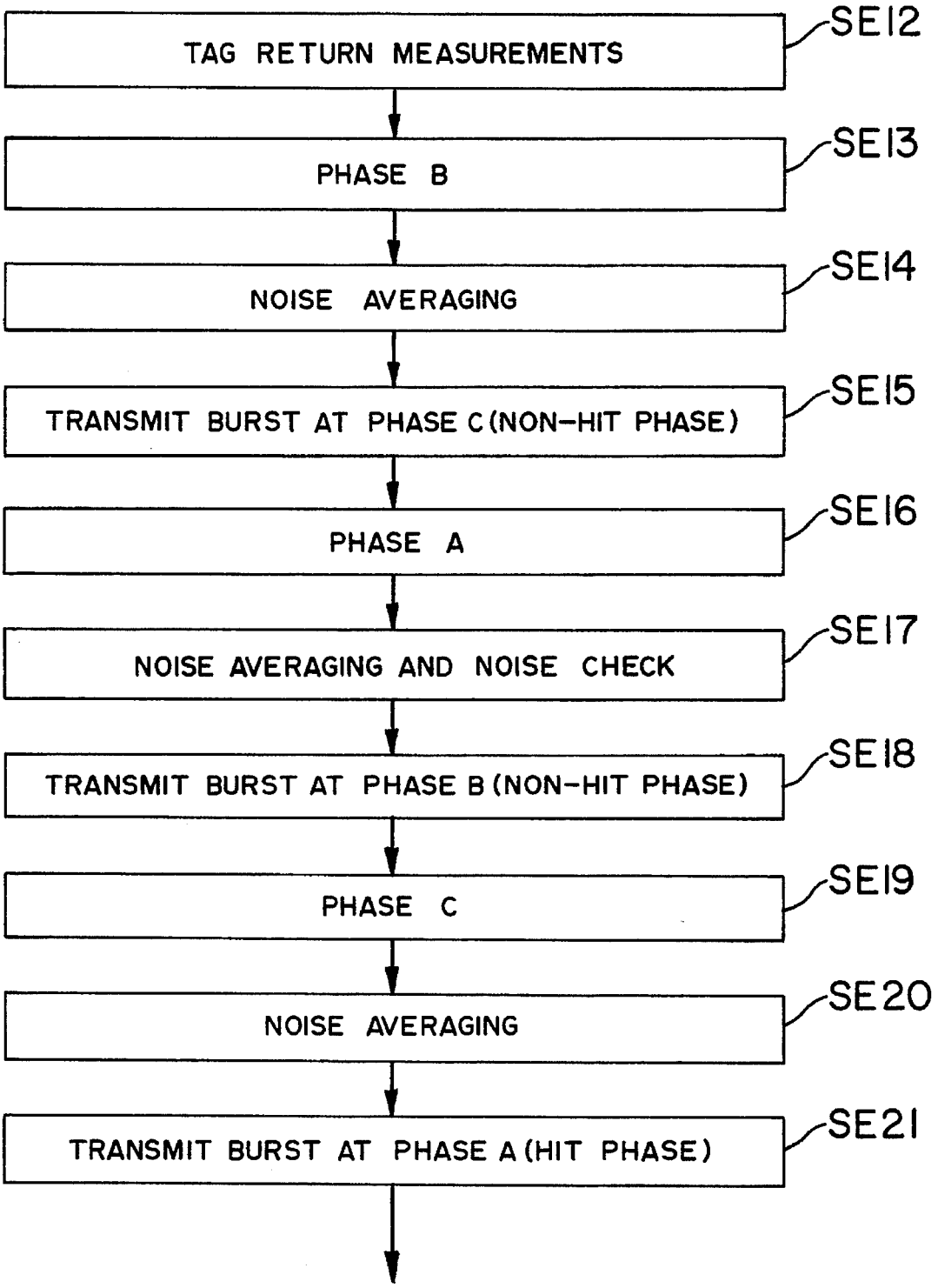
Figure 10C:
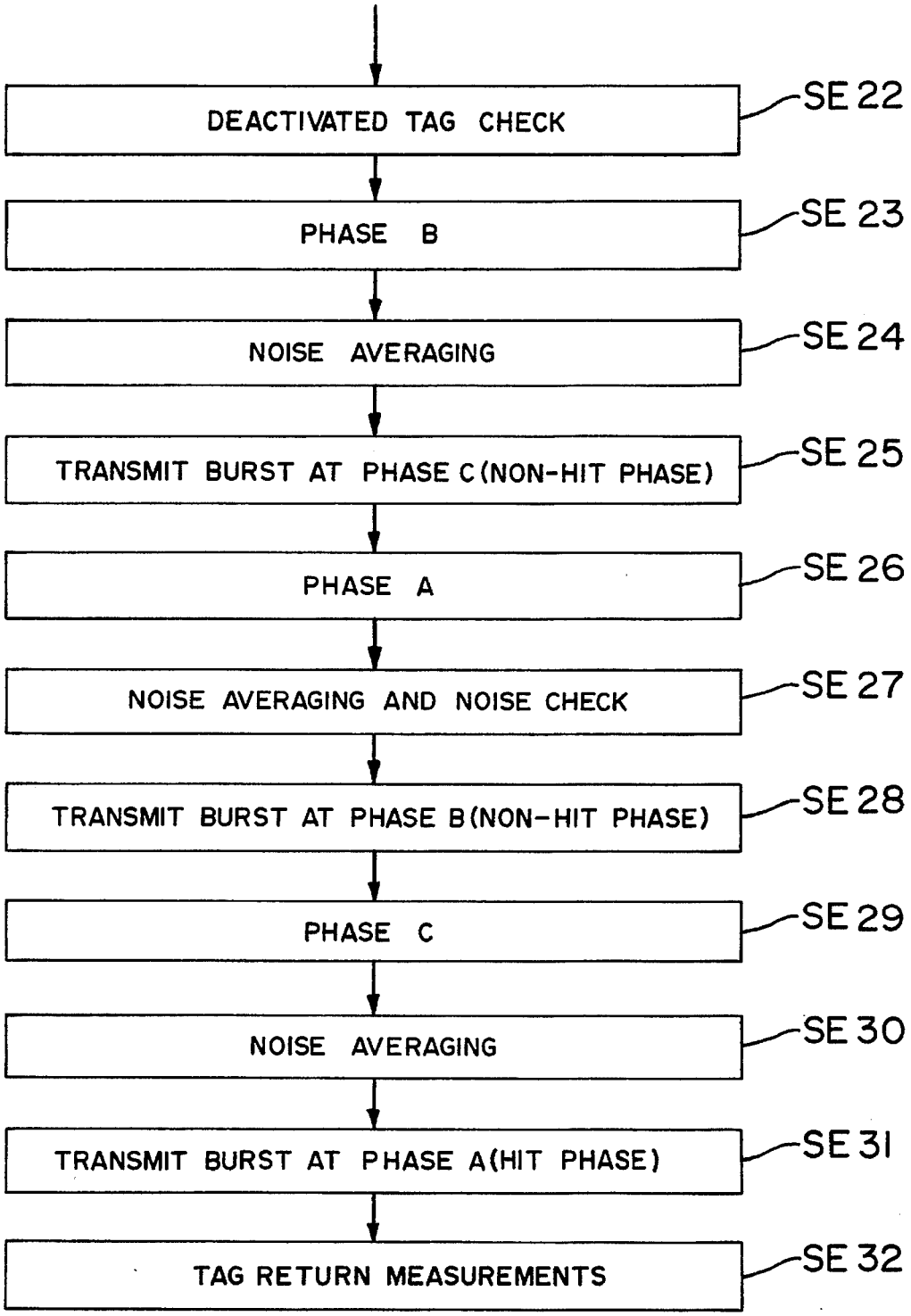

A series of system events (SE) for a successful validation sequence for four hits is shown FIGS. 10A–10C. The example follows the VALSEQ routine of FIGS. 7A–7C, without lines AI or AJ, i.e., P is 4 and is not expanded by the routines of FIGS. 8 or 9.

In SE1, TRANSMIT BURST AT PHASE A (HIT PHASE), a hit has been detected in power mains A phase. Return signal processing takes place in SE2, TAG RETURN MEASUREMENTS.

SE3, PHASE B is a non-hit, non-transmit phase. Per system disciplines above discussed, the system treats the time period as a noise phase, and NOISE AVERAGING occurs in SE4.

SE5, TRANSMIT BURST AT PHASE C (NON-HIT PHASE), is a transmit phase per system timing above discussed, but is not the hit phase A. Accordingly, per step S14 of FIG. 7B, the system does not look to noise averaging in the period.

SE6, PHASE A, is the hit phase but non-transmitting and SE7, NOISE AVERAGING AND NOISE CHECK, accordingly occurs.

SE8, TRANSMIT BURST AT PHASE B (NON-HIT PHASE), is a transmit phase and noise averaging is accordingly not updated during the time period thereof.

SE9, PHASE C, is a non-hit, non-transmit phase and SE10, NOISE AVERAGING, occurs.

SE11, TRANSMIT BURST AT PHASE A (HIT PHASE), is a second hit phase-transmit phase and return signals are processed in SE12, TAG RETURN MEASUREMENTS.

SE13, PHASE B, is a non-hit, non-transmit phase and SE14, NOISE AVERAGING, occurs.

SE15, TRANSMIT BURST AT PHASE C (NON-HIT PHASE), is another transmit phase and noise averaging is accordingly not updated during the time period thereof.

SE16 PHASE A, is a non-transmit hit phase and SE17, NOISE AVERAGING AND NOISE CHECK, is practiced.

SE18, TRANSMIT BURST AT PHASE B (NON-HIT PHASE), is another transmit phase and noise averaging is accordingly not updated during the time period thereof.

SE19, PHASE C, is a non-hit, non-transmit phase and leads to SE20, NOISE AVERAGING.

SE21, TRANSMIT BURST AT PHASE A (HIT PHASE), is a third hit phase-transmit phase and leads to SE22, DEACTIVATED TAG CHECK.

SE23, PHASE B is a non-hit, non-transmit phase and leads to SE24, NOISE AVERAGING.

SE25, TRANSMIT BURST AT PHASE C (NON-HIT PHASE), is a transmit phase and noise averaging is accordingly not updated.

SE26, PHASE A, is a non-transmit hit phase and leads to SE27, NOISE AVERAGING AND NOISE CHECK.

SE28, TRANSMIT BURST AT PHASE B (NON-HIT PHASE) is a transmit phase and noise averaging is accordingly not updated.

SE29, PHASE C, is a non-hit, non-transmit phase, leading to SE30, NOISE AVERAGING.

SE30, TRANSMIT BURST AT PHASE A (HIT PHASE), is the fourth hit phase-transmit phase, leading to SE31, TAG RETURN MEASUREMENTS.

The hit number for verification for the example is seen as four and deactivated tag checking is conducted in the penultimate cycle, i.e., the third hit-phase transmit phase.

By way of summary and introduction to the ensuing claims, in one aspect, the invention will be seen to provide, in combination, in an electrical article surveillance system, a plurality of receiving coils and a noise environment analyzer including circuitry for determining the noise environment individual to each of the receiving coils. The noise environment analyzer includes scanning circuitry for individually connecting the receiving coils thereto and has separate noise analysis channels respectively for each receiving coil.

The noise environment analyzer further includes in each channel thereof first circuitry for individual storing of signals received by the receiving coils, second circuitry for cumulative storage of signals stored by the first circuitry and third circuitry for averaging the signals stored by the second circuitry. The noise environmental analyzer further includes multiplexer circuitry for receiving the output signals of the comparator circuitry and for providing output signals selectively indicative of the averaged noise signals.

The system transmitter may be powered from a multi-phase power source. In that case, the noise environment analyzer further includes separate noise analysis channels respectively for each the receiving coil and for each phase of the multi-phase power source means. The noise analysis channels are arranged in groups corresponding in number to the number of receiving coils and each noise analysis channel group comprises channels in number corresponding to the number of phases of the multi-phase power source.

In a first electronic article surveillance system aspect, the invention provides a system comprising a transmitter operable for generating a magnetic field in a surveillance area and a receiver having a plurality of receiving coils and noise environment analysis circuitry operable for determining the noise environment individual to each of the receiving coils. The system further includes control circuitry (1) for establishing a succession of transmit and non-transmit phases, the transmit phases having a transmit window and a receive window, (2) for operating the transmitter means during the transmit phases and (3) for operating the noise environment analyzer during the non-transmit (noise) phases. The control circuitry operates the receiver, upon receiver detection of an electronic article surveillance tag, to implement a validation sequence on a succession of signals received by the receiving coil which provided the signal giving rise to the detection. The control circuitry operates the transmitter means in one cycle of the validation sequence to transmit energy at a frequency at which a deactivated electronic article surveillance tag is resonant.

In another system aspect, the invention provides a system comprising a transmitter operable for generating a magnetic field in a surveillance area, a receiver having a plurality of receiving coils and operable, upon detection of an electronic article surveillance tag, to implement a validation sequence on a succession of signals received by the receiving coil which provided the signal giving rise to the detection and control circuitry for operating the transmitter means and the receiver means, the control circuitry having facility for varying the number of cycles in the validation sequence.

Particularly, the control circuitry establishes the number of cycles in the validation sequence adaptively to the noise environment of the receiving coil which provided the signal giving rise to the detection. The control circuitry sets a datum number of cycles in the validation sequence and increases the number of cycles above the datum number adaptively to the noise environment of the receiving coil which provided the signal giving rise to the detection. The control circuitry establishes a predetermined signal-to-noise ratio for a tag detection warranting initiation of the validation sequence and increases the number of cycles above the datum number upon actual received signal-to-noise ratio of the receiving coil which provided the signal giving rise to the detection having a preselected relation to the predetermined signal-to-noise ratio.

In a further system aspect, the invention provides a transmitter operable at a fundamental frequency for generating a magnetic field in a surveillance area, a receiver for detection of electronic article surveillance tags and control circuitry for operating the transmitter with a frequency hopping between frequencies respective above and below the fundamental frequency. The transmitter is powered from a multi-phase supply and the control circuitry effects the frequency hopping at every occurrence of an exclusive one of the phases of the multi-phase supply.

Various changes in structure to the described systems and apparatus and modifications in the described practices may evidently be introduced without departing from the invention. For example, the system may selectively skip transmit phases and use the time for noise checking to enhance system performance. Further, while the deactivated tag check has been described as practiced in the penultimate step of VALSEQ, it may be placed in any desired cycle of VALSEQ. These variations may be altered dynamically, as desired. Accordingly, it is to be understood that the particularly disclosed and depicted embodiments are intended in an illustrative and not in a limiting sense. The true spirit and scope of the invention are set forth in the following claims.

What is claimed is:

1. In combination, in an electrical article surveillance system:

(a) a plurality of receiving coils; and (b) noise environment analysis means for determining the noise environment individual to each of said receiving coils.

2. The invention claimed in claim 1, wherein said noise environment analysis means includes scanning means for individually connecting said receiving coils thereto.

3. The invention claimed in claim 2, wherein said noise environment analysis means further includes separate noise analysis channels respectively for each said receiving coil.

4. The invention claimed in claim 3 further including transmitting means for transmitting energy to said receiving coils and multi-phase power source means for excitation of said transmitting means, wherein said noise environment analysis means further includes separate noise analysis channels respectively for each said receiving coil and for each phase of said multi-phase power source means.

5. The invention claimed in claim 4, wherein said noise analysis channels are arranged in groups corresponding in number to the number of receiving coils and wherein each noise analysis channel group comprises channels in number corresponding to the number of phases of said multi-phase power source.

6. The invention claimed in claim 5, wherein each said noise analysis channel includes first means for storing of signals received by a distinct one of said receiving coils for a distinct phase of said multi-phase power source.

7. The invention claimed in claim 6, wherein each said noise analysis channel further includes second means for cumulative storage of signals stored by said first means thereof.

8. The invention claimed in claim 7, wherein each said noise analysis channel further includes third means for averaging the signals stored by said second means thereof.

9. The invention claimed in claim 8, wherein said noise environmental analysis means further includes multiplexer means for receiving said output signals of said third means.

10. The invention claimed in claim 2, wherein said noise environment analysis means further includes first means for individual storing of signals received by said receiving coils.

11. The invention claimed in claim 10, wherein said noise environment analysis means further includes second means for cumulative storage of signals stored by said first means.

12. The invention claimed in claim 11, wherein said noise environmental analysis means further includes third means for averaging the signals stored by said second means.

13. The invention claimed in claim 12, wherein said noise environmental analysis means further includes multiplexer means for receiving said output signals of said third means.

14. An electronic article surveillance system, comprising:

(a) transmitter means operable for generating a magnetic field in a surveillance area; and (b) a receiver having a plurality of receiving coils and noise environment analysis means operable for determining the noise environment individual to each of said receiving coils.

15. The system claimed in claim 14 further including control means for establishing a succession of a transmit and non-transmit phases, each transmit phases having a transmit window and a receive window, for operating said transmitter means during said transmit phases and for operating noise environment analysis means during said non-transmit phases.

16. The system claimed in claim 15, wherein said control means operates said receiver, upon receiver detection of an electronic article surveillance tag, to implement a validation sequence on a succession of signals received by the receiving coil which provided the signal giving rise to said detection.

17. The system claimed in claim 16, wherein said control means operates said transmitter means in one cycle of said validation sequence to transmit energy at a frequency at which a deactivated electronic article surveillance tag is resonant.

18. The system claimed in claim 17, wherein said control means establishes the number of cycles in said validation sequence adaptively to the noise environment determined by said noise environment analysis means.

19. The system claimed in claim 18, wherein said control means sets a datum number of cycles in said validation sequence and increases the number of cycles above said datum number adaptively to the noise environment determined by said noise environment analysis means.

20. The system claimed in claim 19, wherein said control means establishes a predetermined signal-to-noise ratio for a tag detection warranting initiation of said validation sequence and increases the number of cycles above said datum number upon actual received signal-to-noise ratio having a preselected relation to said predetermined signal-to-noise ratio.

21. The system claimed in claim 14, wherein said noise environment analysis means includes scanning means for individually connecting said receiving coils thereto.

22. The system claimed in claim 21, wherein said noise environment analysis means includes separate noise analysis channels respectively for each said receiving coil.

23. The system claimed in claim 22, wherein said noise environment analysis means further includes in each said channel first means for individual storing of signals received by said receiving coils.

24. The system claimed in claim 23, wherein said noise environment analysis means further includes in each said channel second means for cumulative storage of signals stored by said first means.

25. The system claimed in claim 24, wherein said noise environmental analysis means further includes in each said channel third means for averaging the signals stored by said second means.

26. The system claimed in claim 25, wherein said noise environmental analysis means further includes multiplexer means for receiving said output signals of said third means.

27. The system claimed in claim 14, wherein said transmitting means is powered by a multi-phase power source means and wherein said noise environment analysis means further includes separate noise analysis channels respectively for each said receiving coil and for each phase of said multi-phase power source means.

28. The system claimed in claim 27, wherein said noise analysis channels are arranged in groups corresponding in number to the number of receiving coils and wherein each noise analysis channel group comprises channels in number corresponding to the number of phases of said multi-phase power source.

29. The system claimed in claim 28, wherein each said noise analysis channel includes first means for storing of signals received by a distinct one of said receiving coils for a distinct phase of said multi-phase power source.

30. The system claimed in claim 29, wherein each said noise analysis channel further includes second means for cumulative storage of signals stored by said first means thereof.

31. The system claimed in claim 30, wherein each said noise analysis channel further includes third means for averaging the signals stored by said second means thereof.

32. The system claimed in claim 31, wherein said noise environmental analysis means further includes multiplexer means for receiving said output signals of said third means.

33. An electronic article surveillance system, comprising:

(a) transmitter means operable for generating a magnetic field in a surveillance area;

(b) a receiver having a plurality of receiving coils and operable, upon detection of an electronic article surveillance tag, to implement a validation sequence on a succession of signals received by the receiving coil which provided the signal giving rise to said detection; and (c) control means for operating said transmitter means and said receiver means, said control means having facility for varying the number of cycles in said validation sequence.

34. The system claimed in claim 33, wherein said control means establishes the number of cycles in said validation sequence adaptively to the noise environment of said receiving coil which provided the signal giving rise to said detection.

35. The system claimed in claim 34, wherein said control means sets a datum number of cycles in said validation sequence and increases the number of cycles above said datum number adaptively to the noise environment of said receiving coil which provided the signal giving rise to said detection.

36. The system claimed in claim 35, wherein said control means establishes a predetermined signal-to-noise ratio for a tag detection warranting initiation of said validation sequence and increases the number of cycles above said datum number upon actual received signal-to-noise ratio of said receiving coil which provided the signal giving rise to said detection having a preselected relation to said predetermined signal-to-noise ratio.

37. The system claimed in claim 33, wherein said receiver further includes noise environment analysis means operable for determining the noise environment individual to each of said receiving coils.

38. The system claimed in claim 37 wherein said control means establishes a succession of a transmit phase having a transmit window and a receive window, and a noise phase, and operates said transmitter means during said transmit phases and operates said noise environment analysis means during said noise phases.

39. The system claimed in claim 38, wherein said control means operates said receiver, upon receiver detection of an electronic article surveillance tag, to implement a validation sequence on a succession of signals received by the receiving coil which provided the signal giving rise to said detection.

40. The system claimed in claim 39, wherein said control means operates said transmitter means in one cycle of said validation sequence to transmit energy at a frequency at which a deactivated electronic article surveillance tag is resonant.

41. The system claimed in claim 37, wherein said noise environment analysis means includes scanning means for individually connecting said receiving coils thereto.

42. The system claimed in claim 41, wherein said noise environment analysis means includes separate noise analysis channels respectively for each said receiving coil.

43. The system claimed in claim 42, wherein said noise environment analysis means further includes in each said channel first means for individual shoring of signals received by said receiving coils.

44. The system claimed in claim 43, wherein said noise environment analysis means further includes in each said channel second means for cumulative storage of signals stored by said first means.

45. The system claimed in claim 44, wherein said noise environmental analysis means further includes in each said channel third means for averaging the signals stored by said second means.

46. The system claimed in claim 45, wherein said noise environmental analysis means further includes multiplexer means for receiving said output signals of said third means.

47. The system claimed in claim 33, wherein said transmitting means is powered by a multi-phase power source means and wherein said noise environment analysis means further includes separate noise analysis channels respectively for each said receiving coil and for each phase of said multi-phase power source means.

48. The system claimed in claim 47, wherein said noise analysis channels are arranged in groups corresponding in number to the number of receiving coils and wherein each noise analysis channel group comprises channels in number corresponding to the number of phases of said multi-phase power source.

49. The system claimed in claim 48, wherein each said noise analysis channel includes first means for storing of signals received by a distinct one of said receiving coils for a distinct phase of said multi-phase power source.

50. The system claimed in claim 49, wherein each said noise analysis channel further includes second means for cumulative storage of signals stored by said first means thereof.

51. The system claimed in claim 50, wherein each said noise analysis channel further includes third means for averaging the signals stored by said second means thereof.

52. The system claimed in claim 51, wherein said noise environmental analysis means further includes multiplexer means for receiving said output signals of said third means.

53. An electronic article surveillance system, comprising:

(a) transmitter means operable at a fundamental frequency for generating a magnetic field in a surveillance area;

(b) a receiver for detection of electronic article surveillance tags; and (c) control means for operating said transmitter means with a frequency hopping between frequencies respective above and below said fundamental frequency.

54. The system claimed in claim 53 wherein said transmitter means is powered from a multi-phase supply and wherein said control means effects said frequency hopping at every occurrence of an exclusive one of the phases of said multi-phase supply.

55. An electronic article surveillance system, comprising:

(a) transmitter means operable for generating a magnetic field in a surveillance area;

(b) a receiver having a plurality of receiving coils and operable, upon detection of an electronic article surveillance tag, to implement a validation sequence on a succession of signals received by the receiving coil which provided the signal giving rise to said detection; and (c) control means for operating said transmitter means in one cycle of said validation sequence to transmit energy at a frequency at which a deactivated electronic article surveillance tag is resonant.

56. An electronic article surveillance system, comprising:

(a) transmitter means operable for generating a magnetic field in a surveillance area;

(b) a receiver having noise environment analysis means and operable, upon detection of an electronic article surveillance tag, to implement a validation sequence on a succession of signals received thereby; and (c) control means for establishing the number of cycles in said validation sequence adaptively to the noise environment determined by said noise environment analysis means.

57. The system claimed in claim 56, wherein said control means sets a datum number of cycles in said validation sequence and increases the number of cycles above said datum number adaptively to the noise environment determined by said noise environment analysis means.

58. The system claimed in claim 57, wherein said control means establishes a predetermined signal-to-noise ratio for a tag detection warranting initiation of said validation sequence and increases the number of cycles above said datum number upon actual received signal-to-noise ratio having a preselected relation to said predetermined signal-to-noise ratio.

59. The system claimed in claim 56, wherein said control means establishes the number of cycles in said validation sequence adaptively to the noise environment determined by said noise environment analysis means for a single cycle of said validation sequence.

60. The system claimed in claim 56, wherein said control means establishes the number of cycles in said validation sequence adaptively to the noise environment determined by said noise environment analysis means for each cycle of said validation sequence.

* * * * *

UNITED STATES PATENT AND TRADEMARK OFFICE

CERTIFICATE OF CORRECTION

PATENT NO. : 5,495,229

DATED : February 27, 1996

INVENTOR(S) : Brent F. Balch, et al.

It is certified that error appears in the above-indentified patent and that said Letters Patent is hereby corrected as shown below:

Col. 5, line 57, change "coils 18" to -- coils 118 --.

Col. 9, line 66, change "3 db" to -- 13 db --.

Col. 15, line 53, change "shoring" to -- storing --.

Signed and Sealed this

Twenty-third Day of July, 1996

*Attest:*

BRUCE LEHMAN

*Attesting Officer*

*Commissioner of Patents and Trademarks*